US008517479B2

(12) United States Patent
Lee

(10) Patent No.: US 8,517,479 B2
(45) Date of Patent: Aug. 27, 2013

(54) APPARATUS FOR OPENING AND CLOSING THE SHIELD PLATE OF AUTOMATED TELLER MACHINE

(75) Inventor: Jong-Ok Lee, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 120 days.

(21) Appl. No.: 13/130,723

(22) PCT Filed: Nov. 25, 2009

(86) PCT No.: PCT/KR2009/006973

§ 371 (c)(1),
(2), (4) Date: May 23, 2011

(87) PCT Pub. No.: WO2010/062105

PCT Pub. Date: Jun. 3, 2010

(65) Prior Publication Data

US 2011/0221321 A1 Sep. 15, 2011

(30) Foreign Application Priority Data

Nov. 28, 2008 (KR) ..... 10-2008-0119635

(51) Int. Cl.
*A47B 95/02* (2006.01)

(52) U.S. Cl.
USPC ..... 312/319.1; 186/37

(58) Field of Classification Search
USPC ..... 312/327, 222, 211, 328, 329, 223.2, 312/326, 319.1, 319.2; 186/37; 109/24.1; 194/350, 351
See application file for complete search history.

(56) References Cited

U.S. PATENT DOCUMENTS

| | | | | |
|---|---|---|---|---|
| 3,957,173 | A * | 5/1976 | Roudebush | 221/15 |
| 4,919,058 | A * | 4/1990 | Isozaki et al. | 109/24.1 |
| 5,052,730 | A * | 10/1991 | Frank et al. | 292/201 |
| 5,590,609 | A * | 1/1997 | Ramachandran et al. | 109/59 R |
| 5,709,159 | A * | 1/1998 | Mercer et al. | 109/2 |
| 6,834,919 | B1 * | 12/2004 | Mariano | 312/223.2 |
| 6,962,285 | B2 * | 11/2005 | Douglass et al. | 235/379 |
| 7,044,331 | B2 * | 5/2006 | Lee | 221/191 |
| 7,185,740 | B2 * | 3/2007 | Beskitt et al. | 186/37 |
| 7,377,424 | B2 * | 5/2008 | Douglass et al. | 235/379 |
| 7,690,562 | B2 * | 4/2010 | Haney et al. | 235/379 |
| 8,123,121 | B2 * | 2/2012 | Thum et al. | 235/379 |
| 2007/0013271 | A1 * | 1/2007 | Chen | 312/100 |

FOREIGN PATENT DOCUMENTS

| | | | |
|---|---|---|---|
| KR | 20-0374272 | Y1 | 1/2005 |
| KR | 10-0789643 | B1 | 12/2007 |
| KR | 10-2008-0091999 | A | 10/2008 |
| KR | 10-2008-0092000 | A | 10/2008 |

OTHER PUBLICATIONS

English translation of KP 10-0789643 from KIPO.*
PCT International Search Report and Written Opinion, PCT/KR2009/006973, Jul. 15, 2010, 9 Pages.

* cited by examiner

*Primary Examiner* — Darnell Jayne
*Assistant Examiner* — Daniel Rohrhoff
(74) *Attorney, Agent, or Firm* — Fenwick & West LLP

(57) ABSTRACT

Provided is an apparatus for opening and closing a shield plate in an automated teller machine (ATM). When a unit processing module is attached to a front cover, a media entrance may be opened. When the unit processing module is detached from the front cover, the media entrance may be closed. Accordingly, it is possible to prevent various types of financial accidents and safety accidents occurring while the unit processing module is attached to and detached from the unit processing module.

7 Claims, 7 Drawing Sheets

APPARATUS FOR OPENING AND CLOSING THE SHIELD PLATE OF AUTOMATED TELLER MACHINE

TECHNICAL FIELD

The present invention relates to an apparatus for opening and closing an interception plate in an automatic teller machine (ATM), and more particularly, to an apparatus for opening and closing an interception plate in an ATM that may close a media entrance of a front cover in the case of detachment of a unit processing module and thereby prevent financial accidents and customer injury occurring during an attachment and detachment process of the unit processing module.

BACKGROUND ART

In general, an automatic teller machine (ATM) may be installed in a financial institution such as a bank and the like, to provide convenient services for customers without restriction on a time and an occasion. Also, the ATM may be installed in a convenient store, a public place, and the like, in addition to the financial institution. The ATM may provide a variety of financial services, for example, depositing or withdrawing of paper media such as notes and checks, checking of the balance, an account transfer, and the like. The ATM may include a unit processing module that is modularized for each function, for example, a depositing and withdrawing device, a card reader, a bankbook arrangement device, and a main controller, and the like.

The depositing and withdrawing module may include a withdrawing portion to externally discharge paper media from the ATM and a depositing portion to receive paper media within the ATM. The depositing and withdrawing module may include only one of the withdrawing portion and the depositing portion.

A front cover may be disposed on a front of the unit processing module, and a media entrance for entering and exiting of the paper media may be formed on the front cover. For maintenance and repair, the unit processing module may be disposed to be movable into a front direction and a rear direction within the ATM. When the unit processing module moves to a rear, a maintenance and repair work for repairing the unit processing module or depositing and withdrawing paper media in the unit processing module may be readily performed at the rear of the ATM.

However, when the unit processing module moves to the rear and is detached from a rear surface of the front cover, a customer may not accurately recognize the detachment of the unit processing module. Specifically, since the customer is incapable of directly verifying the movement of the unit processing module due to the front cover, a financial accident that the customer may deposit paper media into the media entrance of the front cover even though the unit processing module is detached from the front cover.

In addition, when the customer puts the customer's hand into the media entrance of the front cover without accurately recognizing the detachment of the unit processing module, a safety accident that the customer's hand may be injured when the unit processing module is attached may occur.

DISCLOSURE OF INVENTION

Technical Goals

An aspect of the present invention provides an apparatus for opening and closing an interception plate in an automatic teller machine (ATM) that enables an interception plate to open and close a media entrance of a front cover during an attachment and detachment process of a unit processing module and thereby prevent a financial accident and a safety accident of a customer.

Another aspect of the present invention also provides an apparatus for opening and closing an interception plate in an ATM that may be readily configured on a front cover using a relatively small number of components.

Technical Solutions

According to an aspect of the present invention, there is provided an apparatus for opening and closing an interception plate in an automatic teller machine (ATM) including a unit processing module mounted on a rear surface of a front cover with a media entrance, the apparatus including: the interception plate being movably mounted to the media entrance to open and close the media entrance; a pivoting portion being pivotably mounted on the rear surface of the front cover; a connecting portion being formed on one side of the pivoting portion and being connected to the interception plate; and an interfering portion being formed on another side of the pivoting portion to interfere with the unit processing module or be released from the unit processing module according to attachment or detachment of the unit processing module, thereby pivoting the pivoting portion into a direction for opening or closing the media entrance.

In the case of attachment of the unit processing module, the interfering portion may interfere with the unit processing module to pivot the pivoting portion into a direction for opening the media entrance. In the case of detachment of the unit processing module, the interfering portion may be released from the unit processing module to pivot the pivoting portion into a direction for closing the media entrance.

As described above, when the unit processing module is attached to and detached from the front cover, the interfering portion may pivot the pivoting portion, thereby enabling the interception plate to open and close the media entrance. Accordingly, during an attachment and detachment process of the unit processing module, it is possible to opportunely open and close the paper media. Specifically, when the media entrance is closed while attaching or detaching the unit processing module, it is possible to prevent a customer from putting a hand or depositing paper media into the media entrance in a state where the front cover and the unit processing module are not properly mounted.

In addition, the interception plate opening and closing apparatus of the ATM may be provided in a very simple structure and thus, be configured using a relatively small number of components and costs, and may be simply applicable to various types of financial automatic apparatuses.

A through hole may be formed in the interception plate, and a stopper may be formed around the through hole. The connecting portion may be provided in a protrusion shape that is movably inserted into the through hole so that an end of the connecting portion may be stopped in the stopper when the pivoting portion performs a pivoting operation. Due to the above connection structure between the interception plate and the connecting portion, even though operation directions of the connecting portion and the interception plate do not match, a slip may occur between the connecting portion and the interception plate and the connecting portion may smoothly move the interception plate.

The interfering portion may include at least one roller member making a rolling contact with the unit processing module in the case of attachment of the unit processing module. That is, when the at least one roller member of the interfering portion makes a rolling contact with the unit processing module, it is possible to reduce noise and friction occurring when the interfering portion interferes with the unit processing module.

In the meantime, the interception plate opening and closing apparatus of the ATM may further include an elastic member of which one side is disposed on the front cover and of which another side is disposed on the interception plate or the pivoting portion to provide an elastic force to the interception plate or the pivoting portion into a direction for closing the media entrance. Accordingly, when the unit processing module is detached from the front cover, the media entrance may be automatically closed due to the elastic force of the elastic member and thus, it is possible to enhance the use convenience of the interception plate opening and closing apparatus.

The front cover may include a support frame being mounted on each of both sides of the pivoting portion to pivotably support the pivoting portion. An elongated guide hole portion may be formed in the support frame along a movement direction of the interception plate. A guide protrusion to be movably inserted in the elongated guide hole portion may be formed in the interception plate. Accordingly, the support frame may pivotably support the pivoting portion and also movably support the interception plate.

Also, the elastic member may include a coil spring of which both ends are connected to the guide protrusion and the support frame. Accordingly, the support frame may also perform a functionality of supporting the elastic member.

Advantageous Effect

According to embodiments of the present invention, there may be provided an apparatus for opening and closing an interception plate in an automatic teller machine (ATM) that may open a media entrance when a unit processing module is attached to a front cover, and may close the media entrance when the unit processing module is detached from the front cover, thereby preventing a customer from putting a hand or depositing paper media into the media entrance during an attachment and detachment process of the unit processing module.

Accordingly, it is possible to prevent a safety accident such as the customer's hand put into the media entrance being caught between the front cover and the unit processing module in the case of attachment of the unit processing module, and to prevent a financial accident that the ATM may not normally process paper media deposited into the media entrance in the case of detachment of the unit processing module.

According to embodiments of the present invention, by simply adding the interception plate, a pivoting portion, a connecting portion, and an interfering portion on a rear surface of the front cover, it is possible to readily open and close the media entrance when attaching and detaching the unit processing module. Therefore, the present invention may be conveniently applicable to various types of financial automatic apparatuses and significantly decrease installation costs.

In addition, the connecting portion may be movably inserted into a through hole of the interception plate and then, an end of the connecting portion may be stopped by a stopper formed around the through hole. Accordingly, even though the connecting portion and the interception plate operate into different directions, a slip may occur between the connecting portion and the interception plate and the connecting portion may smoothly move the interception plate.

The interfering portion may include a roller member interfering with the unit processing module and thus, it is possible to decrease noise and friction occurring due to interference between the interfering portion and the unit processing module.

In addition, according to embodiments of the present invention, since an elastic member is disposed to provide an elastic force to the interception plate into a direction for closing the media entrance, the elastic member may automatically close the media entrance in the case of detachment of the unit processing module, thereby enhancing the use convenience of the interception plate opening and closing apparatus.

According to embodiments of the present invention, a support frame disposed on a rear surface of the front cover may pivot the pivoting portion and also movably support the interception plate. Therefore, the pivoting portion and the interception plate may further stably operate and the structure of the interception plate opening and closing apparatus may be further simplified.

Since modularization of each of the support frame, the pivoting portion, the interception plate, and the elastic member is enabled, the interception plate opening and closing apparatus may be simply installed between the front cover and the unit processing module.

BEST MODE FOR CARRYING OUT THE INVENTION

Figure 1:
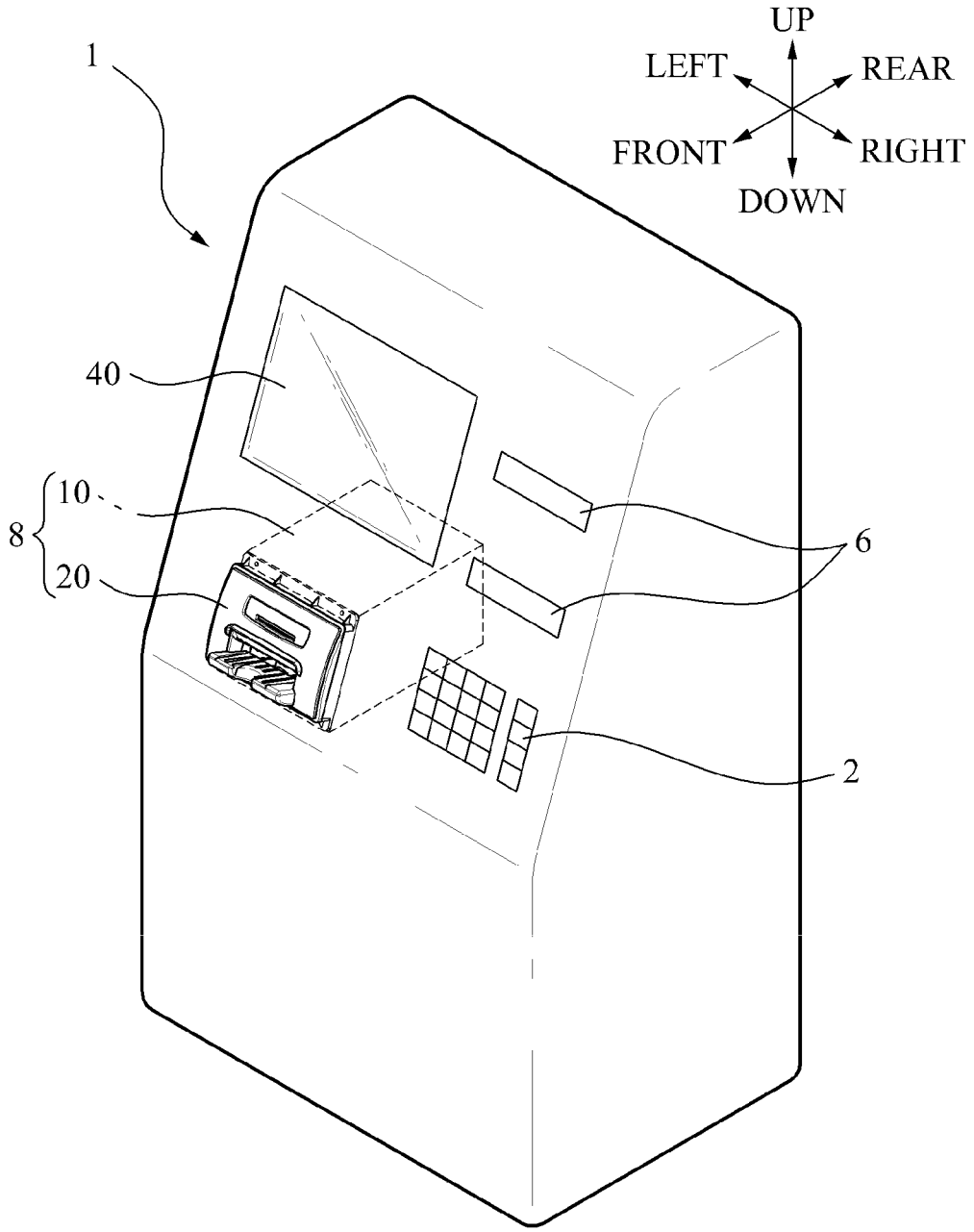
FIG. 1 is a perspective view illustrating an automatic teller machine (ATM) including an apparatus for opening and closing an interception plate according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Hereinafter, an apparatus for opening and closing an interception plate in an automatic teller machine (ATM) according to an embodiment of the present invention will be described with reference to the accompanying drawings.

Figure 2:
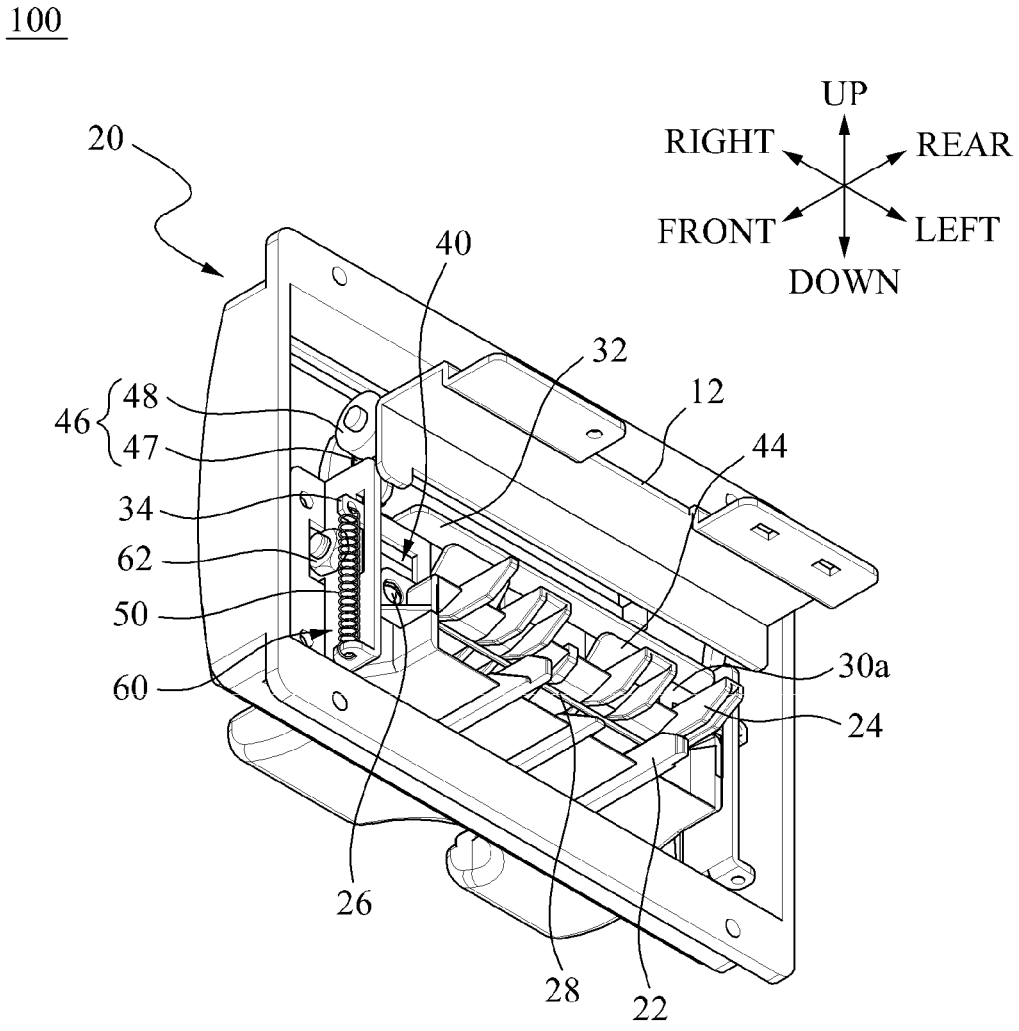
FIG. 2 is a perspective view illustrating the interception plate opening and closing apparatus of FIG. 1.
Figure 3:
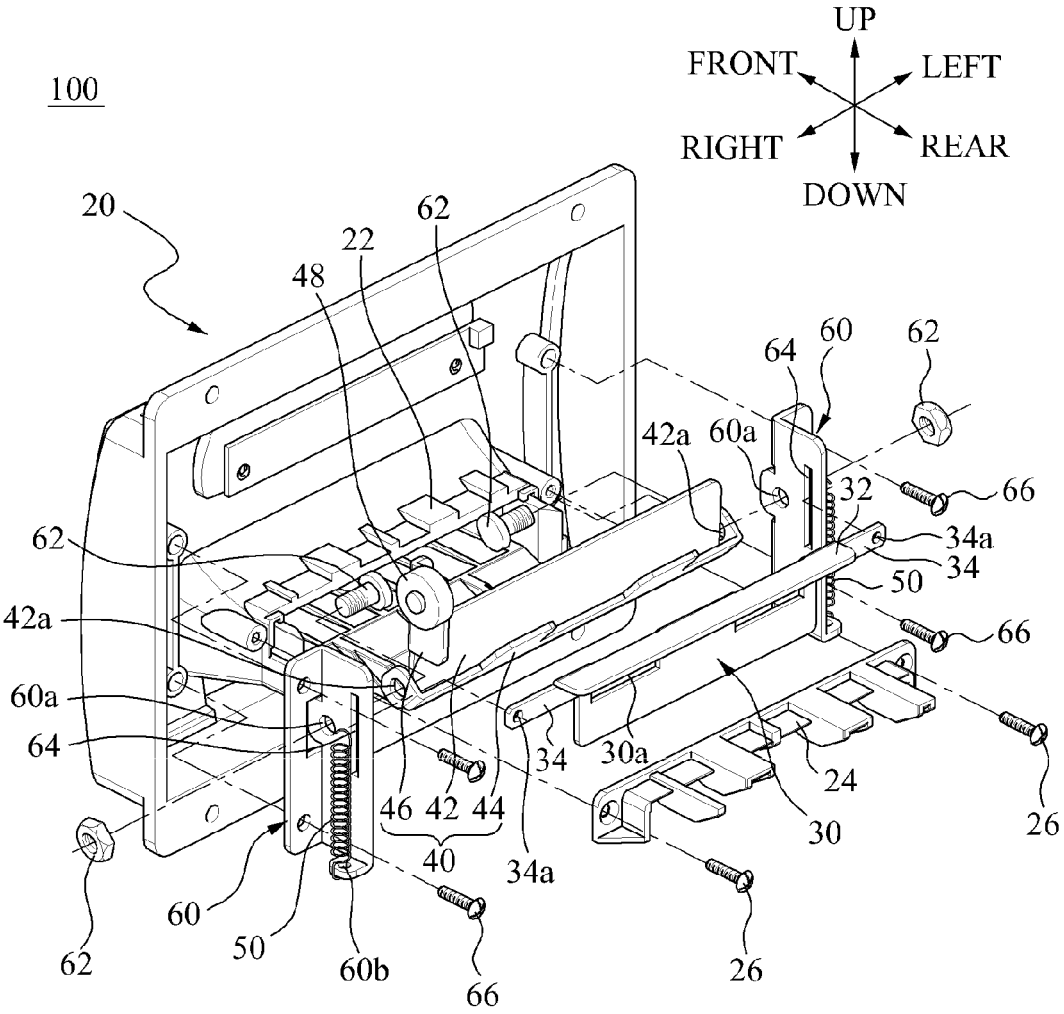
FIG. 3 is an exploded perspective view illustrating a front cover of FIG. 2.
Figure 4:
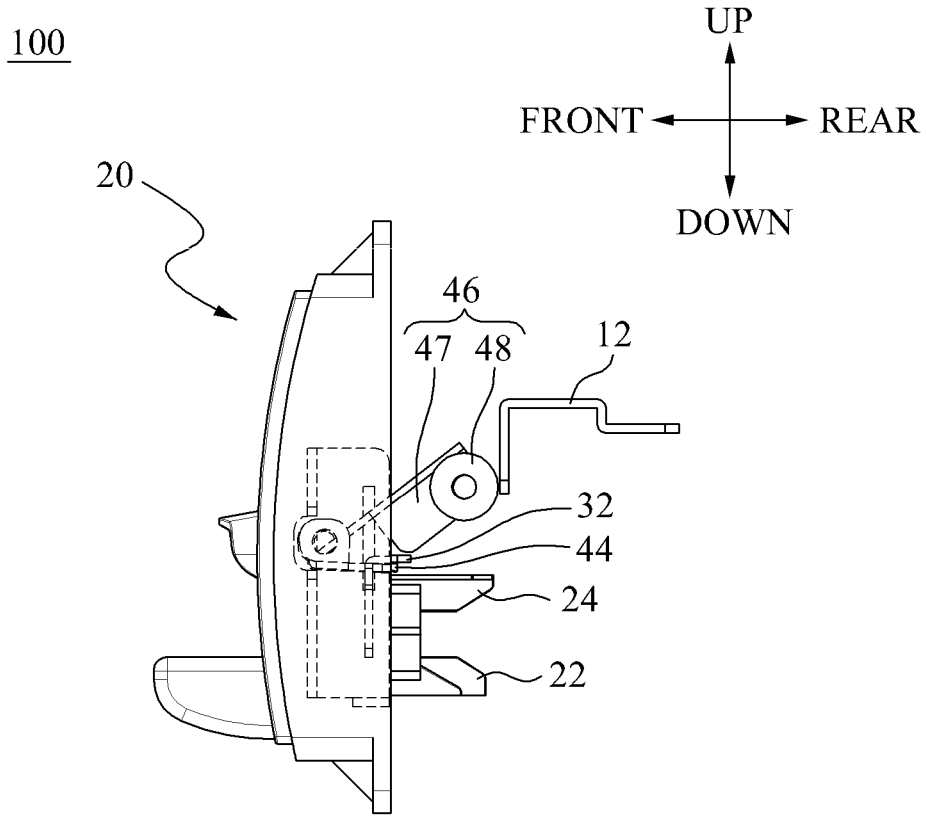
FIG. 4 is right side view illustrating a state in which a unit processing module is detached from the front cover of FIG. 2.
Figure 5:
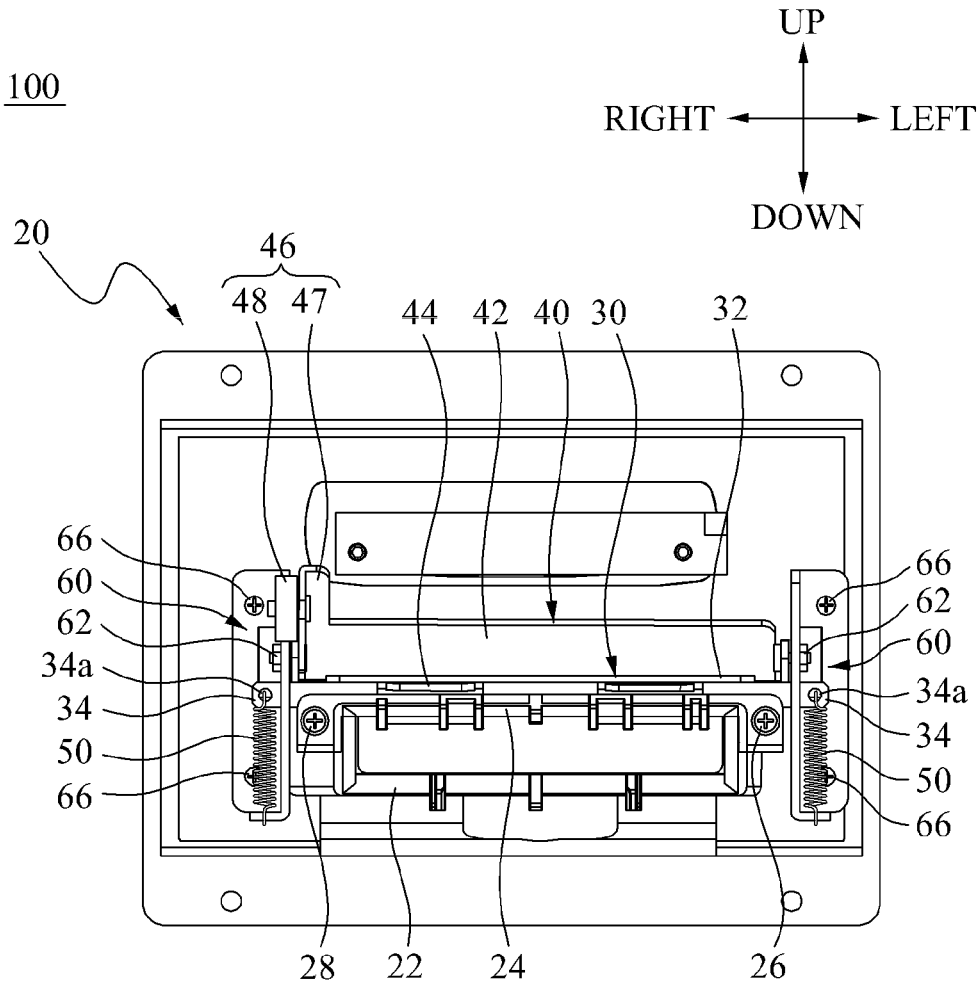
FIG. 5 is a rear view illustrating the front cover of FIG. 4.
Figure 6:
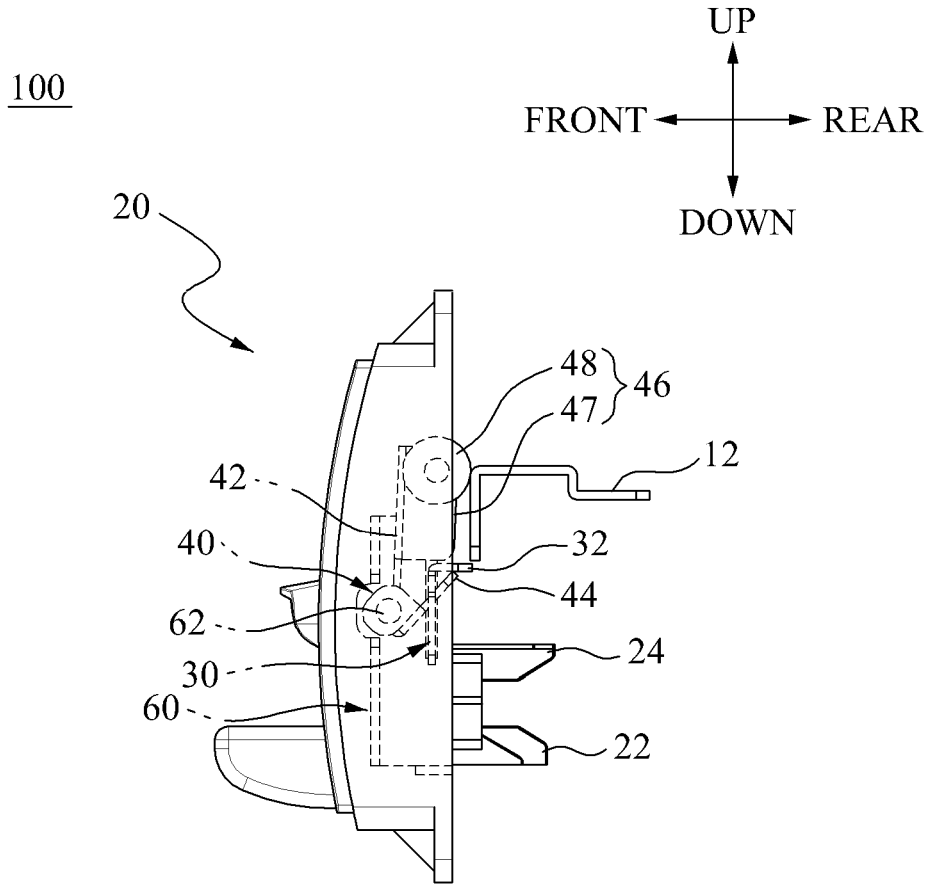
FIG. 6 is a right side view illustrating a state in which the unit processing module is attached to the front cover of FIG. 2.
Figure 7:
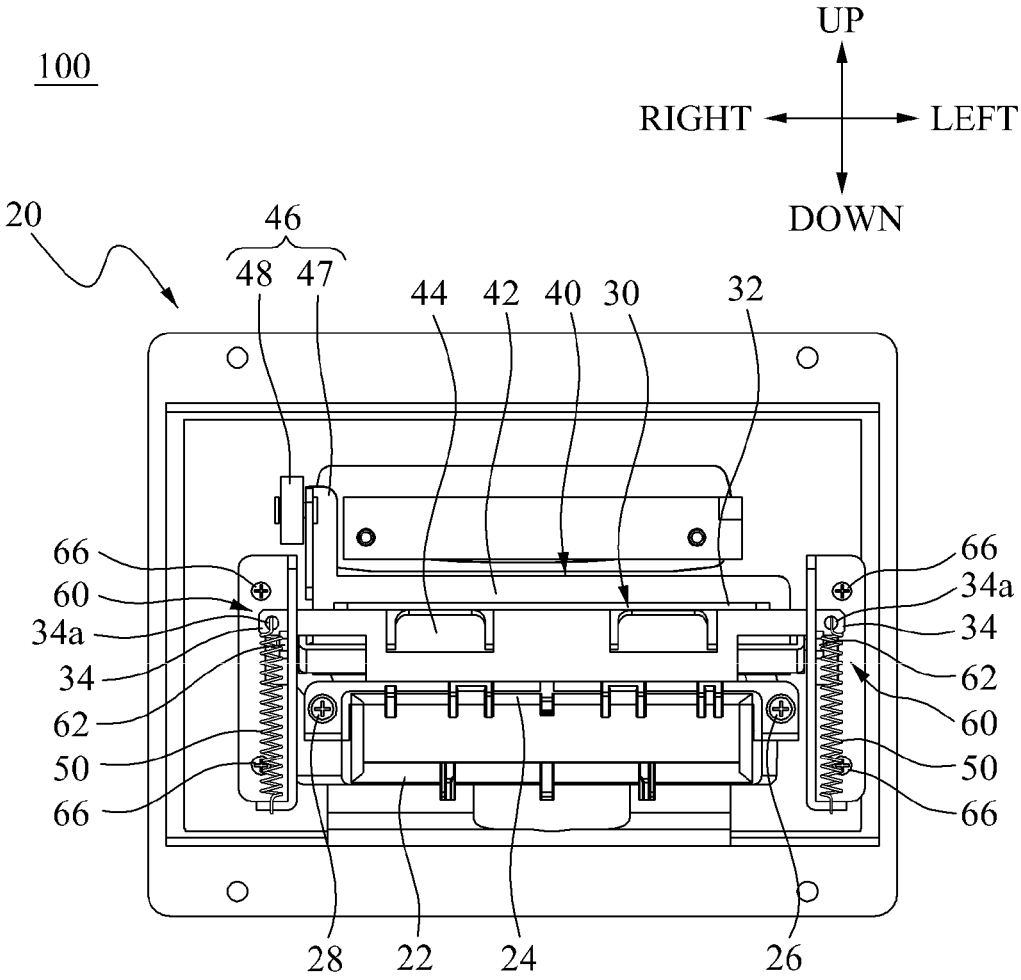
FIG. 7 is a rear view illustrating the front cover of FIG. 6.

FIG. 1 is a perspective view illustrating an ATM 1 including an apparatus 100 for opening and closing an interception plate according to an embodiment of the present invention, FIG. 2 is a perspective view illustrating the interception plate opening and closing apparatus 100 of FIG. 1, and FIG. 3 is an exploded perspective view illustrating a front cover 20 of FIG. 2. FIG. 4 is a right side view illustrating a state in which a unit processing module is detached from the front cover 20 of FIG. 2 and FIG. 6 is a right side view illustrating a state in which the unit processing module is attached to the front cover 20 of FIG. 2. FIG. 5 is a rear view illustrating the front cover of FIG. 4 and FIG. 7 is a rear view illustrating the front cover 20 of FIG. 6.

Referring to FIG. 1, the ATM 1 of the present invention may include a unit processing module modularized for each function. The unit processing module may include a manipulation unit 2 to receive various types of passwords, numbers, and the like, a display unit 4 to display an operation state of the ATM 1 and an input value of the manipulation unit 2, a recognition unit 6 to recognize a card or a bankbook, a depositing and withdrawing device 8 to deposit and withdraw paper media such as a note and a check, a control unit that is connected to the manipulation unit 2, the display unit 4, the recognition unit 6, and the depositing and withdrawing device 8 in order to control operations of the manipulation unit 2, the display unit 4, the recognition unit 6, and the depositing and withdrawing device 8, and the like.

The depositing and withdrawing device 8 may include a depositing portion to deposit paper media into the ATM 1 and a withdrawing portion to discharge the paper money from the ATM 1. That is, the depositing and withdrawing device 8 may include at least one of the depositing portion and the withdrawing portion. Hereinafter, description will be made based on a case where the depositing and withdrawing device 8 includes both the depositing portion and the withdrawing portion.

The unit processing module may be configured as a module into which at least two of the manipulation unit 2, the display unit 4, the recognition unit 6, the depositing and withdrawing device 8, and the control unit are integrated. However, the present embodiment will be described based on an example in which each of the manipulation unit 2, the display unit 4, the recognition unit 6, the depositing and withdrawing device 8, and the control unit is modularized.

Referring to FIG. 1 through FIG. 3, the ATM 1 may further include the front cover 20 being disposed on a front of the unit processing module. Hereinafter, the present embodiment will be described by limiting the unit processing module to a depositing and withdrawing device 10. However, it is only an example and thus, a variety of modules may be employed.

The front cover 20 may include a media entrance 22 to guide entrance and exit of paper media. The media entrance 22 corresponds to an entering and exiting passage of paper media that is provided in the front cover 20. The media entrance 22 may be formed so that an inside may pass through into a front direction and a rear direction. An internal passage of the media entrance 22 may be formed to have a wider width than a width of paper media and to have a higher height than a height of a predetermined number of paper media.

A front portion and a rear portion of the media entrance 22 may be protruded from a front portion and a rear portion of the front cover 20, respectively. The front portion of the media entrance 22 may be provided in a structure in which the height of the internal passage is expanded along getting closer to the front portion. The rear portion of the media entrance 22 may be provided in a structure in which the height of the internal passage is expanded along getting closer to the rear portion. This is because the entrance of paper media into the front portion and the rear portion of the media entrance 22 may become easier.

Also, a portion of the rear portion of the media entrance 22 may be formed as a guide member 24 that is attached to and detached from a combining member 26 on a rear surface of the front cover 20. When the portion of the rear portion of the media entrance 22 is formed as a separate component, assembly of an interception plate 30 and an opening and closing instrument 40 may be further readily performed. Hereinafter, description will be made based on an example in which only an upper portion of the rear portion of the media entrance 22 is formed as the guide member 24. However, the whole rear portion of the media entrance 22 may be formed as the guide member 24. Each of a side portion and a lower portion of the rear portion of the media entrance 22 may be formed as the guide member 24.

Referring to FIG. 2 through FIG. 7, the interception plate opening and closing apparatus 100 according to an embodiment of the present invention may further include the interception plate 30 being movably mounted to the media entrance 22 to open and close the media entrance 22, and the opening and closing equipment 40 being pivotably disposed on the rear surface of the front cover 20 to move the interception plate 30 into a direction for opening the media entrance 22 in the case of installation of the depositing and withdrawing device 10 and to move the interception plate 30 into a direction for closing the media entrance 22 in the case of detachment of the depositing and withdrawing device 10.

The interception plate 30 may correspond to a member in a planar shape and thereby be mounted to the rear portion of the media entrance 22 to be upwardly and downwardly movable. That is, a plurality of guide members 24 may be disposed spaced apart from each other at predetermined intervals in an upper portion of the rear portion of the media entrance 22, whereby an elongated slit hole 28 may be formed on an upper surface of the rear portion of the media entrance 22 into a left direction and a right direction. A lower portion of the interception plate 30 may be inserted into the slit hole 28 to be upwardly and downwardly movable.

The opening and closing instrument 40 may include a pivoting portion 42 being pivotably mounted on the rear surface of the front cover 20, a connecting portion 44 being formed in a lower portion of the pivoting portion 42 and being connected to the interception plate 30, and an interfering portion 46 being formed in an upper portion of the pivoting portion 42 to interfere with a front surface of the depositing and withdrawing device 10 when the depositing and withdrawing device 10 is attached and detached.

The pivoting portion 42 corresponds to a planar member that is disposed to be in parallel with the rear surface of the front cover 20. The lower portion of the pivoting portion 42 may be pivotably mounted on the rear surface of the front cover 20 so that an upper portion of the pivoting portion 42 may be moved towards the rear portion of the front cover 20.

The connecting portion 44 may be provided in a protrusion shape that is obliquely protruded from the lower portion of the pivoting portion 42 towards the interception plate 30. A through hole 30*a* may be formed in the interception plate 30 to be passed through by the connecting portion 44 and thereby be inserted therewith. A stopper 32 may be formed around the through hole 30*a*. Even though a plurality of connecting portions 44, the through holes 30, and the stoppers 32 may be formed on the pivoting portion 42 and the interception plate to correspond to each other, the present embodiment will be described based on an example in which two connecting portions 44, through holes 30, and stoppers 32 are disposed to be spaced apart from each other on left and right.

In addition, in the present embodiment, the connecting portion 44 may be obliquely protruded from the lower portion of the pivoting portion upwardly towards the rear portion, and the stopper 32 may be formed on only an upper portion of the through hole 30*a*. Accordingly, in the case of pivoting of the pivoting portion 42, when the connecting portion 44 rotates in a state where the connecting portion 44 is inserted into the through hole 30*a*, the stopper 32 may upwardly and downwardly move in correspondence to a change in a height of an end of the connecting portion 44. The interception plate 30 may also upwardly and downwardly move in correspondence to the upward and downward movement of the stopper 32.

In this instance, the connecting portion 44 may rotate when the pivoting portion 42 pivots. The interception plate 30 may be linearly moved into upward and downward directions with respect to the slit hole 28. As described above, even though the connecting portion 44 and the interception plate 30 move in different directions, the connecting portion 44 may move along the pass hole 30*a* in a state where the connecting portion 44 is stopped by the stopper 32. Accordingly, a position change of the connecting portion 44 and the interception plate 30 may be compensated for.

At least one interfering portion 46 may be provided in the upper portion of the pivoting portion 42 to be contactable with the front surface of the depositing and withdrawing device 10 in the case of installation of the depositing and withdrawing device 10. Specifically, the interfering portion 46 may include at least one support member 47 being protruded from the upper portion of the pivoting portion 42 and at least one roller member 48 being rotatably mounted to the at least one support member 47 to make a rolling contact with the front surface of the depositing and withdrawing device 10.

The support member 47 may be upwardly protruded from the upper portion of the pivoting portion 42. Hereinafter, description will be made based on an example in which the single support member 47 is disposed on the right of the upper portion of the pivoting portion 42. The roller member 48 may be rotatably mounted to the support member 47 to be rotatable into the same direction as a pivoting direction of the pivoting portion 42. Accordingly, since the roller member 48 and the depositing and withdrawing device 10 interferes with each other due to a rolling contact structure, it is possible to decrease noise and friction occurring due to interference in attachment and detachment of the depositing and withdrawing device 10.

In the meantime, an interference frame 12 may be mounted on the front surface of the depositing and withdrawing 10 in a portion corresponding to the roller member 48. That is, the interference member 12 corresponds to a component contacting with the roller member 48 in the case of installation of the depositing and withdrawing device 10, and may protect the depositing and withdrawing device 10 from the interference with the roller member 48.

Referring to FIG. 2 through FIG. 7, a support frame 60 pivotably supporting the opening and closing instrument 40 and also supporting the interception plate 30 to be upwardly and downwardly movable may be mounted on the rear surface of the front cover 20. At least one support frame 60 may be disposed on the rear surface of the front cover 20. The present embodiment will be described based on an example in which the support frame 60 is disposed on each of a left side and a right side of the interception plate 30 and the opening and closing instrument 40 to thereby support both sides of the interception plate 30 and the opening and closing instrument 40.

Hinge holes 42*a* and 60*a* may be respectively formed in lower portions of the pivoting portion 42 and the support frame 60 to correspond to each other. A hinge member 62 may be combined with the hinge holes 42*a* and 60*a*. A bolt, a nut, a rivet, a shaft, a ring, and the like may be used for the hinge member 62. Hereinafter, an example of using the bolt and the nut for the hinge member 62 will be described.

A guide hole portion 64 may be formed in the support frame 60 to be in an upwardly and downwardly elongated form. A guide protrusion 34 may be protruded from both sides of the interception plate 30 and be inserted into the guide hole portion 64 to be upwardly and downwardly movable. Accordingly, the support frame 60 may support the interception plate 30 to be upwardly and downwardly movable by means of the guide hole portion 64 and the guide protrusion 34.

Also, combining holes 34*a* and 60*b* may be respectively formed in an end of the guide protrusion 34 of the interception plate 30 and the lower portion of the support frame 60. Both ends of an elastic member 50 may be connected to the combining holes 34*a* and 60*b*. Specifically, both ends of the elastic member 50 may be mounted to the combining holes 34*a* and 60*b* of the guide protrusion 34 and of the support frame 60 to provide the elastic force into a direction for closing the media entrance 22. Even though a coil spring, a pan spring, an elastic cable, and the like may be used for the elastic member 50, the present embodiment will be described using an example of employing the coil spring for the elastic member 50. Accordingly, when the depositing and withdrawing device 10 is detached from the rear surface of the front cover 20, the interception plate 30 may downwardly move due to the elastic force of the elastic member 50, whereby the internal passage of the media entrance 22 may be automatically closed by the interception plate 30.

In the meantime, the support frame 60 may be attachably ad detachably mounted on the rear surface of the front cover 20 using a combining member 66. Accordingly, the support frame 60, the interception plate 30, the opening and closing instrument 40, and the elastic member 50 may be preassembled and thereby the modularization of components may be configured.

Hereinafter, an assembly process and operation with respect to the interception plate opening and closing apparatus 100 of the ATM 1 constructed as above will be described.

Initially, referring to the assembly process of the interception plate opening and closing apparatus 100, after mounting the support frame 60 to each of both sides of the pivoting portion 42 of the opening and closing instrument 40, the hinge member 62 may be combined with the hinge holes 42*a* and 60*a* formed in the pivoting portion 42 of the opening and closing instrument 40 and the support frame 60. After inserting the guide protrusion 34 of the interception plate 30 into the guide hole portion 64 of the support frame 60 mounted to each of the both sides of the pivoting portion 42, both ends of the elastic member 50 may be connected to the combining holes 34*a* and 60*b* formed in the end of the guide protrusion 34 and the lower portion of the support frame 60.

When the support frame 60, the opening and closing instrument 40, the interception plate 30, and the elastic member 50 are assembled into a single module as described above, the support frame 60 may be mounted on the rear surface of the front covert 20 using the combining member 66. In this instance, the lower portion of the interception plate 30 may be disposed in the upper portion of the rear portion of the media entrance 22 to which the guide member 24 is not mounted.

Next, the assembly of the front cover 20 may be completed by disposing the guide member 24 in the upper portion of the rear portion of the media entrance 22 using the combining member 26. That is, when the guide member 24 is mounted to the rear portion of the media entrance 22, the slit hole 28 may be formed between the rear portion of the media entrance 22 and the guide member 24. The lower portion of the interception plate 30 may be disposed in the slit hole 28 to be upwardly and downwardly movable.

In the meantime, the ATM 1 may perform the maintenance and repair of the depositing and withdrawing device 10 by moving the depositing and withdrawing device 10 to the rear portion. When the maintenance and repair of the depositing and withdrawing device 10 is completed, the ATM 1 may move the depositing and withdrawing device 10 to the front and thereby mount the depositing and withdrawing device 10 on the rear surface of the front cover 20. Hereinafter, an operation of the interception plate opening and closing apparatus 100 while the depositing and withdrawing device 10 is attached to and detached from the rear surface of the front cover 20 will be described.

FIG. 4 and FIG. 5 illustrate a state in which the depositing and withdrawing device 10 is detached from the rear surface of the front cover 20 to the rear portion. In this instance, the interception plate 30 descends due to the elastic force of the elastic member 50 and the lower portion of the interception plate 30 is received in the bottom surface of the rear portion of the media entrance 22. The opening and closing instrument 40 is rotated by the interception plate 30, whereby the roller member 48 of the interfering portion 46 is protruded towards the rear portion.

Since the internal passage of the media entrance 22 of the front cover 20 is closed by the interception plate 30, it may be possible to completely prevent the customer from putting paper media or a hand into the media entrance 22. Accordingly, during a process of mounting the depositing and withdrawing device 10 on the rear surface of the front cover 20, it may be possible to prevent the customer's hand from being stuck between the depositing and withdrawing device 10 and the front cover 20, and to prevent paper media inserted into the media entrance 22 from not being appropriately processed.

When the depositing and withdrawing device 10 is moved to the front towards the rear surface of the front cover 20, the roller member 48 of the interfering portion 46 of the opening and closing instrument 40 may interfere with the interference frame 12 of the depositing and withdrawing device 10 whereby the interfering portion 46 may be moved towards the rear surface of the front cover 20. Due to the movement of the interfering portion 46, the pivoting portion 42 of the opening and closing instrument may also be pivoted. The stopper 32 of the interception plate 30 may be lifted up by means of the connecting portion 44 moving together with the pivoting portion 42, whereby the interception plate 30 may be upwardly moved. As the interception plate 30 is upwardly moved, the internal passage of the media entrance 22 may also be opened.

FIG. 6 and FIG. 7 illustrate a state in which the depositing and withdrawing device 10 is mounted on the front surface of the front cover 20. In this instance, due to the interference between the interference frame 12 and the roller member 48, an upper portion of the opening and closing instrument 40 rotates to the front whereby the roller member 48 of the interfering portion 46 closely contacts with the rear surface of the front cover 20. The interception plate 30 is upwardly moved by the connecting portion 44 of the opening and closing instrument 40 whereby the lower portion of the interception plate 30 is mounted to an upper portion of the rear portion of the media entrance 22.

As the depositing and withdrawing device 10 is mounted on the rear surface of the front cover 20 as described above, the pivoting portion 42 of the opening and closing instrument 40 may be pivoted and the roller member 48 may rotate by a predetermined angle in correspondence to a change in a position of the roller member 48 and the interference frame 12. Accordingly, while preventing noise and friction from occurring in the contact surface between the interfering portion 46 of the opening and closing instrument 40 and the interference frame 12 of the depositing and withdrawing device 10, the opening and closing instrument 40 may be very softly and smoothly pivoted.

Due to the lift of the interception plate 30, the internal passage of the media entrance 22 of the front cover 20 is in an open state and thus, entering and exiting of paper media via the media entrance 22 is enabled and an operation of the depositing and withdrawing device 8 may be normally performed. That is, the paper media may be moved from the depositing and withdrawing device 10 to an outside via the internal passage of the media entrance 22. Also, the paper media may be moved from the outside to the depositing and withdrawing device 10 via the internal passage of the media entrance 22.

When the interception plate 30 is upwardly moved, the elastic member 50 may be extended. Accordingly, when the depositing and withdrawing device 10 is detached from the front cover 20, the interception plate 30 may be automatically descended due to the elastic force of the elastic member 50 and the internal passage of the media entrance 22 may be closed again. That is, the interception plate opening and closing apparatus 100 may automatically open and close the internal passage of the media entrance 22 during the attachment and detachment process of the depositing and withdrawing device 10 without a need to manually open and close the internal passage of the media entrance 22.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. An apparatus for opening or closing a media entrance in an automatic teller machine, the apparatus comprising:

an opening or closing instrument comprising:

a pivoting portion pivoted to a front cover providing the media entrance, one or more connecting portions extending from the pivoting portion, and an interfering portion attached to the pivoting portion, the interfering portion interacting with a portion of a unit processing module to rotate the opening or closing instrument toward or away from the front cover; and an interception plate moving to open or close the media entrance based on interaction of the interfering portion and the portion of the unit processing module, the interception plate formed with one or more through holes and a stopper at a side of the one or more through holes, each of the through holes configured to receive a corresponding connection portion of the opening or closing instrument, the stopper configured to come in contact with the one or more connection portions to move the interception plate according to rotation of the opening or closing instrument.

2. The apparatus of claim 1, wherein:

responsive to attaching the unit processing module, the interfering portion is pushed by the portion of the unit processing module to rotate the opening or closing instrument towards the front cover, the interception plate is raised to open the media entrance responsive to the rotation of the opening or closing instrument towards the front cover, and responsive to detaching the unit processing module, the interfering portion is released from the portion of the unit processing module to rotate the opening or closing instrument away from the front cover, the interception plate is lowered to close the media entrance responsive to the rotation of the opening or closing instrument away from the front cover.

3. The apparatus according to claim 2, further comprising:

an elastic member disposed between the front cover and interception plate or the pivoting portion to provide an elastic force to the interception plate or the pivoting portion to close the media entrance when the interfering portion is not pushed by the portion of the unit processing module.

4. The apparatus of claim 3, wherein:

the front cover comprises two supporting frames, each mounted on one end of the pivoting portion to pivotably support the pivoting portion, and an elongated guide hole portion is formed in the support frame along a movement direction of the interception plate, and the interception plate is formed with a guide protrusion movably inserted through the elongated guide hole portion.

5. The apparatus of claim 4, wherein the elastic member comprises a coil spring having one end connected to the guide protrusion and having another end connected to the support frame.

6. The apparatus of claim 1, wherein the interfering portion comprises at least one roller member making a rolling contact with the portion of the unit processing module responsive to attachment of the unit processing module.

7. The apparatus of claim 1, wherein the pivoting portion and the one or more connecting portions are integrated into a single body.

* * * * *